US006769866B1

(12) United States Patent
Kannefass et al.

(10) Patent No.: US 6,769,866 B1
(45) Date of Patent: Aug. 3, 2004

(54) TURBINE BLADE AND METHOD FOR PRODUCING A TURBINE BLADE

(75) Inventors: Ralf Kannefass, Erlangen (DE); Markus Tacke, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/936,051

(22) PCT Filed: Mar. 9, 2000

(86) PCT No.: PCT/DE00/00734

§ 371 (c)(1),
(2), (4) Date: Jan. 10, 2002

(87) PCT Pub. No.: WO00/53896

PCT Pub. Date: Sep. 14, 2000

(30) Foreign Application Priority Data

Mar. 9, 1999 (DE) ..... 199 10 380

(51) Int. Cl.[7] ..... F01D 5/28

(52) U.S. Cl. ..... 415/115; 415/200; 416/97 R; 416/230; 416/241 A; 416/241 B; 428/408; 428/698

(58) Field of Search ..... 415/115, 116, 415/200; 416/96 R, 96 A, 97 R, 230, 241 A, 241 B; 428/408, 698

(56) References Cited

U.S. PATENT DOCUMENTS

| | | | | |
|---|---|---|---|---|
| 3,717,419 A | | 2/1973 | Olcott | |
| 4,617,072 A | | 10/1986 | Merz | |
| 4,645,421 A | * | 2/1987 | Huether | 416/241 B |
| 4,671,997 A | | 6/1987 | Galasso et al. | |
| 5,242,264 A | * | 9/1993 | Kojima et al. | 415/200 |
| 5,403,153 A | | 4/1995 | Goetze | |
| 5,419,039 A | | 5/1995 | Auxier et al. | |
| 5,462,800 A | | 10/1995 | Yamazaki et al. | |
| 5,667,359 A | | 9/1997 | Huber et al. | |
| 5,702,232 A | | 12/1997 | Moore | |

FOREIGN PATENT DOCUMENTS

| | | |
|---|---|---|
| DE | 2242111 | 3/1973 |
| DE | 3327 659 A1 | 2/1985 |
| EP | A1657404 | 6/1995 |
| GB | A2293415 | 3/1996 |

* cited by examiner

*Primary Examiner*—Christopher Verdier
(74) *Attorney, Agent, or Firm*—Harness, Dickey & Pierce, P.L.C.

(57) ABSTRACT

A turbine blade extends along a major axis from a root region via a blade leaf region capable of being acted upon by hot gas to a head region. The turbine blade is formed essentially from carbon-fiber-reinforced carbon, at least the blade leaf region having a blade outer wall with carbon-fiber-reinforced carbon, the blade outer wall being surrounded by a protective layer.

17 Claims, 3 Drawing Sheets

TURBINE BLADE AND METHOD FOR PRODUCING A TURBINE BLADE

This application is the national phase under 35 U.S.C. §371 of PCT International Application No. PCT/DE00/00734 which has an International filing date of Mar. 9, 2000, which designated the United States of America, the entire contents of which are hereby incorporated by reference.

FIELD OF THE INVENTION

The invention relates to a turbine blade of a turbine, in particular of a gas or steam turbine. The turbine blade extends along a major axis from a root region via a blade leaf region to a head region. The invention relates, furthermore, to a method for producing a turbine blade and to a turbine plant, in particular a gas turbine plant.

BACKGROUND OF THE INVENTION

The efficiency of a gas turbine plant is determined critically by the turbine inlet temperature of the working medium which is expanded in the gas turbine. The aim, therefore, is to achieve temperatures which are as high as possible. However, because of the high temperatures, the turbine blades are subjected to pronounced thermal load, and, due to the high flow velocity of the working medium or hot gas, to pronounced mechanical load. Blades produced by casting are normally used for the turbine blades. This involves lost-wax casting, partially solidified directionally or drawn as a monocrystal.

A device and a method for production of castings, in particular gas turbine blades, with a directionally solidified structure are described in DE-B 22 42 111. In this case, the turbine blade is cast as a solid-material blade predominantly from nickel alloys in monocrystalline form.

A cooled gas turbine blade may be gathered from U.S. Pat. No. 5,419,039. The turbine blade disclosed in this is likewise produced as a casting or is composed of two castings.

SUMMARY OF THE INVENTION

The turbine blades are normally operated at temperatures near to the maximum permissible temperature for the material of the turbine blade, what is known as the load limit. For example, the turbine inlet temperature of gas turbines is approximately 1500 to 1600 K, on account of the temperature limits of the materials used for the turbine blade, and, as a rule, even a cooling of the blade surfaces is carried out. An increase in the turbine inlet temperature requires a larger cooling-air quantity, thereby impairing the efficiency of the gas turbine and consequently also that of an overall plant, in particular a gas and steam turbine plant. The reason for this is that the cooling air is normally extracted from a compressor preceding the gas turbine. This compressed cooling air is therefore no longer available for combustion and for the performance of work. Furthermore, because of the thermal expansion of the turbine blades, it is necessary to have a gap which, above all in the part-load range of the gas turbine, leads to what are known as gap losses.

SUMMARY OF THE INVENTION

An object of the invention is, therefore, to specify a turbine blade which has particularly favorable properties in terms of high mechanical resistance and thermal stability. Another object is to specify a method for producing a turbine blade.

These and/or other objects are achieved, according to the invention, by means of a turbine blade which extends along a major axis from a root region via a blade leaf region capable of being acted upon by hot gas to a head region and is formed essentially from carbon-fiber-reinforced carbon, at least the blade leaf region having a blade outer wall with carbon-fiber-reinforced carbon, said blade outer wall being surrounded by a protective layer.

By carbon-fiber-reinforced carbon being used as the material for the turbine blade, the latter has particularly high thermal and mechanical stability. In particular, as compared with conventional monocrystalline turbine blades, higher turbine inlet temperatures up to 2800 K become possible. Preferably, even in the case of large wall thickness differences between the blade leaf region and the solid root region or at the root region and the head region, the same material structure and therefore essentially the same physical properties are achieved in all the blade regions.

By virtue of the particularly high thermal stability of the material used for the turbine blade, it is no longer necessary for the turbine blade to be cooled, with the result that a particularly high efficiency of the turbine plant is achieved. For particularly good oxidation resistance of the carbon-fiber-reinforced carbon, a protective layer is provided, which surrounds at least the blade outer wall acted upon by hot gas when the turbine plant is in operation.

A ceramic layer is expediently provided as a protective layer. In particular, a layer of silicon carbide is suitable for the ceramic layer produced as a straightforward surface layer. The use of silicon carbide has the effect that, by the reaction of the silicon with the carbon, the surface of the turbine blade is sealed with a thin silicon carbide layer and is thereby protected very effectively. On account of its particularly oxidation-inhibiting property, silicon carbide is especially suitable as a protective layer for the turbine blade composed of carbon-fiber-reinforced carbon.

The ceramic layer expediently has a minimum value in terms of its layer thickness of between 0.5 and 5 mm. Depending on the place of installation of the turbine blade, in particular on the thermal load prevailing there, the ceramic layer may also be produced as a multilayer.

In a further particularly advantageous refinement, the protective layer is provided, alternatively or additionally, by a gaseous protective film which is formed by a protective gas. Advantageously, at least in the blade leaf region, a feed for the protective gas is provided, which is surrounded by the blade inner wall. The cavity formed by the blade inner wall makes it possible for the protective gas to be fed in a particularly simple way.

To prevent the oxidation of the carbon-fiber-reinforced carbon, that is to say of the basic material of the turbine blade, natural gas, water vapor or inert gas is advantageously provided as protective gas. For example, exhaust gas, nitrogen or a noble gas is used as inert gas. Use of the protective gas ensures a particularly uniform distribution on the blade surface with the assistance of gas dynamics. The particularly good flow properties of the protective gas thus make it possible to form a closed and surface-covering protective film on the blade surface.

To distribute the protective gas on the surface of the blade outer wall, the turbine blade preferably has a double-shell design at least in the blade leaf region. For example, the wall of the turbine blade may have a double-walled design, with a blade inner wall surrounding the feed and with a blade outer wall extending along the blade inner wall. Between the blade outer wall and the blade inner wall a plurality of cavities are expediently formed which in each case are flow-connected to the feed by at least one associated inlet. In an advantageous refinement, to form the cavities, a plurality of spacers are arranged in the manner of a grid. To reduce the weight of the turbine blade, the spacers are expediently produced from carbon-fiber-reinforced carbon. By the spacers being arranged in the manner of a grid, it becomes possible to have a particularly effective through-flow of the protective gas in the cavities over a long distance. Preferably, in the blade outer wall, a plurality of discharges are provided, which guide the protective gas outward from each cavity. In particular, the feeds and discharges are selected in terms of number and size in such a way that the protective gas flows around the blade outer wall. The protective gas is therefore guided through the turbine blade in an open protective circuit. In this case, the protective gas flows via the discharges, out of the cavities onto the blade outer wall and forms a protective film on that surface of the blade outer wall which is capable of being exposed to the hot gas (comparable to what is known as film cooling). The discharges and the feeds are preferably designed as a bore or a plurality of bores. These may, for example, be widened in a funnel-shaped manner. Such an acute angle is particularly conducive to the formation of a film on the surface of the blade outer wall.

A double-walled construction of this type makes it possible to uncouple the functional properties of the wall structure, while it is possible for the blade outer wall to satisfy lower mechanical stability requirements than the blade inner wall. Consequently, since it is not exposed directly to a hot-gas flow, the blade inner wall can be produced with a larger wall thickness than the blade outer wall and assume essentially the mechanical carrying function for the turbine blade. The cross section of the cavity region between the blade outer wall and the blade inner wall is preferably made as small as possible, in order to generate a high velocity of the protective gas, and, in particular, is in the range of the wall thickness of the blade outer wall. A small throughflow cross section of the cavity and a high velocity of the protective gas thus generated achieve a particularly good protective-film property, especially also an efficient discharge of heat by the protective gas.

The turbine blade is preferably designed as a moving or guide blade of a turbine, in particular of a gas or steam turbine, in which temperatures of well above 1000° C. of the hot gas flowing around the turbine blade during operation occur. The blade leaf region of the turbine blade expediently has a height of between 5 cm and 50 cm. The wall thickness of the blade outer wall and/or of the blade inner wall preferably has a minimum value of between 0.5 mm and 5 mm.

Insofar as an object is directed at a method for producing a turbine blade which extends along a major axis from a root region via a blade leaf region to a head region, it is achieved, according to the invention, in that a plurality of carbon fibers are processed in such a way that the carbon fibers form the shape of the turbine blade, there being arranged between the carbon fibers synthetic resin which, when heated under airtightly closed conditions, is converted into a matrix of pure carbon surrounding the carbon fibers.

A turbine blade with sufficient thermal and mechanical strength properties can thereby be produced, which has an essentially identical material structure both in a solid region and in a thin-walled region. The process parameters of the method, for example, winding and adhesive bonding during the processing of the carbon fibers, the temperature and duration of the heating operation and the type of synthetic resin used, etc., are adapted to the size and the desired strength properties of the turbine blade.

BRIEF DESCRIPTION OF THE DRAWINGS

The turbine blades and the method for producing the turbine blade are explained in more detail with reference to the exemplary embodiments illustrated in the drawing, in which.

DETAILED DESCRIPTION OF THE PREFERRED EMBODIMENTS

Parts corresponding to one another are given the same reference symbols in all the figures.

Figure 1:
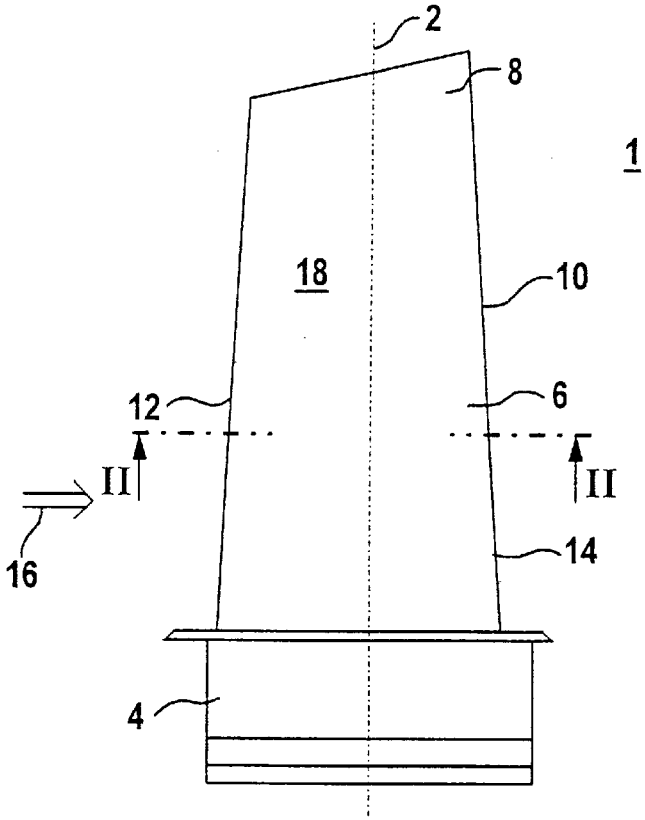
FIG. 1 shows a longitudinal view of a turbine blade.

FIG. 1 illustrates an exemplary turbine blade 1, in particular a moving blade of a stationary gas turbine, extending along a major axis 2 from a root region 4 via a blade leaf region 6 to a head region 8. The blade leaf region 6 has a blade outer wall 10, a flow-on region 12 and a flow-off region 14. During operation, the gas turbine, not illustrated in any more detail, has flowing through it a hot working medium 16 ("hot gas") which flows onto the turbine blade 1 into the flow-on region 12 and flows past along the blade outer wall 10 as far as the flow-off region 14. The turbine blade 1 is formed from carbon-fiber-reinforced carbon. This material is what is known as a composite fiber material which has carbon both as matrix and as fiber. Due to carbon-fiber-reinforced carbon being used, the turbine blade 1 is suitable for use up to temperatures of 2800 K because of the particularly high mechanical and thermal strength.

Figure 2:
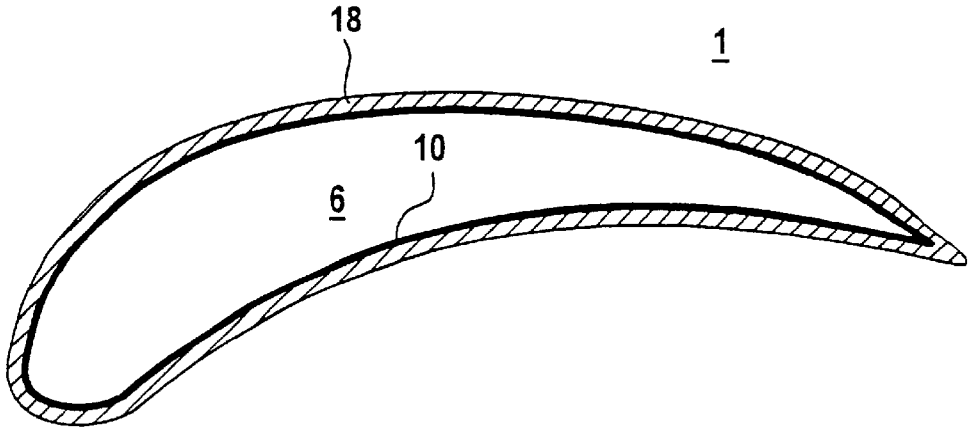
FIG. 2 shows a turbine blade with a protective layer in cross sections, along line II—II of FIG. 1.

To increase the oxidation resistance of the turbine blade 1, composed of carbon-fiber-reinforced material, according to FIG. 2, said turbine blade has, at least in the blade leaf region 6, a protective layer 18 which surrounds the blade outer wall 10 and particularly in this case also forms the outer boundary of the blade outer wall 10. What serves in this case as a protective layer 18 is a ceramic layer which is applied to the basic material, the carbon-fiber-reinforced carbon. For example, the ceramic layer is formed from silicon carbide.

Silicon carbide is particularly suitable because of its good processability and on account of the good bonding properties with carbon. The ceramic layer has in this case, at its thinnest point, a value of the layer thickness of between 0.5 and 5 mm.

Figure 3:
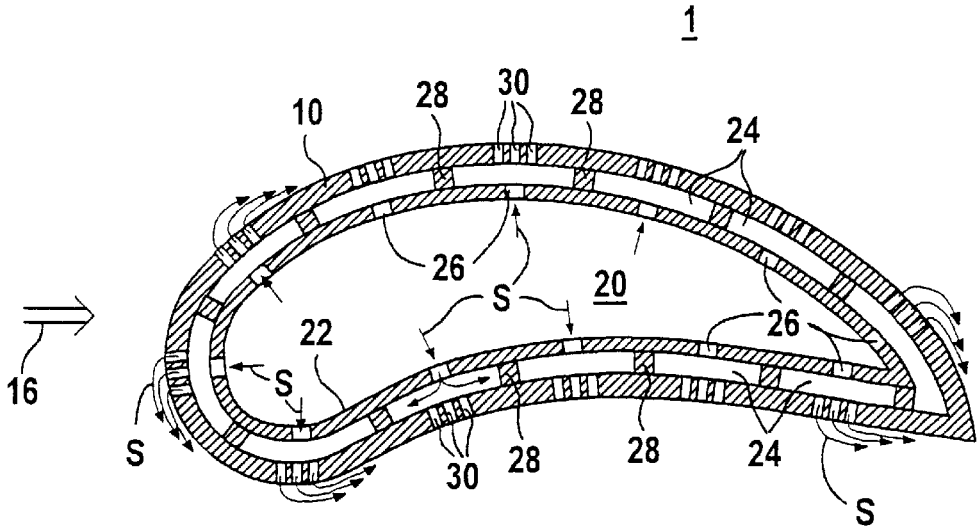
FIG. 3 shows a turbine blade with at least one cavity in cross section.

In FIG. 3, an alternative embodiment of the turbine blade 1 can be seen, which, instead of a solid ceramic layer, has a protective film formed from a protective gas S, for the purpose of avoiding oxidation. For this purpose, the turbine blade 1 has a double-shell, in particular double-walled, design. A feed 20 is surrounded by a blade inner wall 22. The feed 20 extends as a cavity along the major axis 2 of the turbine blade 1 (cf. FIG. 1). The blade inner wall 22 is designed to be load-bearing and likewise extends along the major axis 2. Like conventional turbine parts, it may be manufactured from metal, but preferably consists of the same material as the outer wall 10.

The protective gas S is guided via the feed 20 through the root region 4 into the blade leaf region 6 (see also FIG. 1). The protective gas S is, in particular, natural gas, water vapor or inert gas, which is fed to the turbine blade 1 by a feed line, not illustrated. In this case, the blade inner wall 22 is located opposite the blade outer wall 10. Between the blade outer wall 10 and the blade inner wall 22 are arranged a plurality of cavities 24 with an essentially sheet-like extent extending along the blade walls 22, 10. Each cavity 24 is flow-connected to the feed 20 for the protective gas S via an associated inlet 26. To form the cavities 24, a number of spacers 28 are provided between the blade outer wall 10 and the blade inner wall 22.

The protective gas S flowing into the respectively associated cavity 24 via the inlet 26 is guided into the flow of the working medium 16 via a number of discharges 30 in the blade outer wall 10. In this case, the discharges 30 are designed in terms of number and shape in such a way that the protective gas S flows directly along the blade outer wall 10, with the result that a snugly fitting protective film is formed on the outer surface of the blade outer wall 10.

Figure 4:
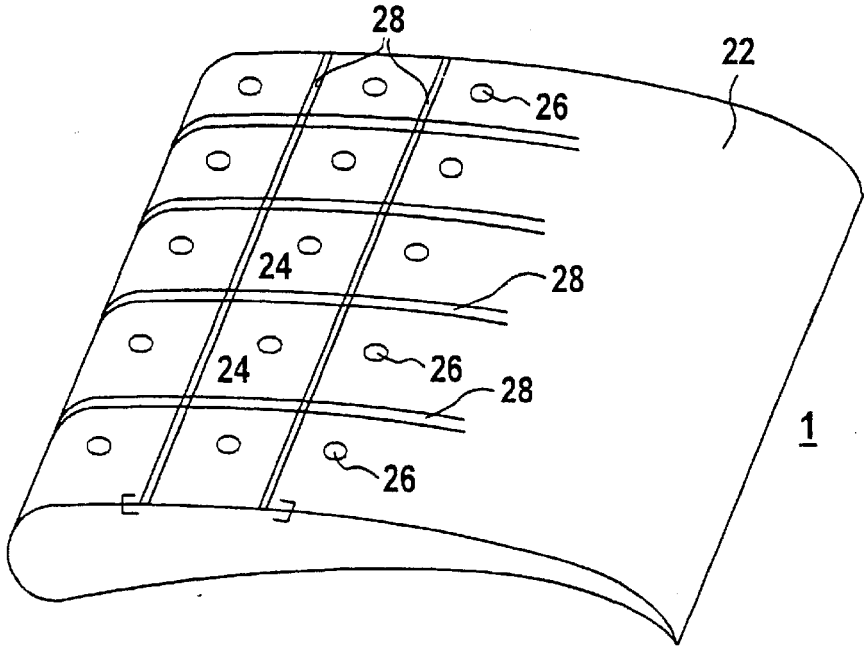
FIG. 4 shows a portion of the turbine blade according to FIG. 2 with a cavity and spacers.

FIG. 4 shows, after the removal of the outer wall 10, a detail of a turbine blade 1, according to FIG. 3 in the region of the cavities 24, with a plurality of inlets 26 and a plurality of spacers 28 which are arranged in the manner of a grid. By the spacers 28 being arranged in the manner of a grid, the cavities 24 are formed in a correspondingly regular way. The arrangement in the form of a grid assumes the support of the blade outer wall 10 in relation to the blade inner wall 22.

Figure 5:
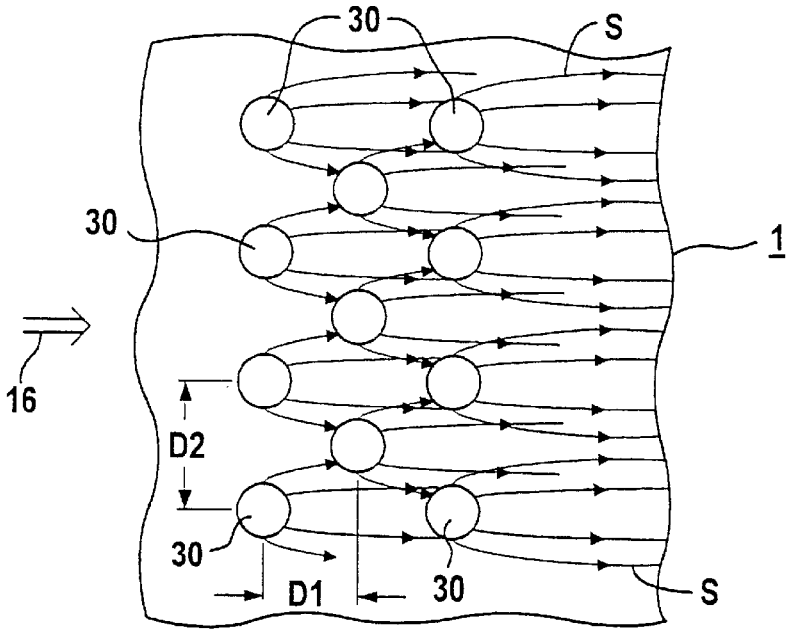
FIG. 5 shows a detail of a top view of the turbine blade.

FIG. 5 shows a detail of a top view of the turbine blade 1 with a plurality of circular discharges 30. The discharges 30 are designed preferably as bores which, arranged directly one behind the other, in each case form a row, the rows being arranged so as to be offset to one another. What is achieved thereby is a particularly efficient and uniform distribution of the protective gas S flowing out of the discharges 30. Adjacent rows of discharges 30 are in each case arranged at a distance D1 from one another. Within a row, the discharges 30 are in each case at a distance D2 from one another. The distance D1 between two adjacent rows is approximately equal to or somewhat smaller than the distance D2 between adjacent discharges 30 within a row of discharges 30. The diameter of the discharges 30 of circular cross section and the hole grid to be selected depend on the mass flow and pressure of the protective gas S which are to be achieved.

Figure 6:
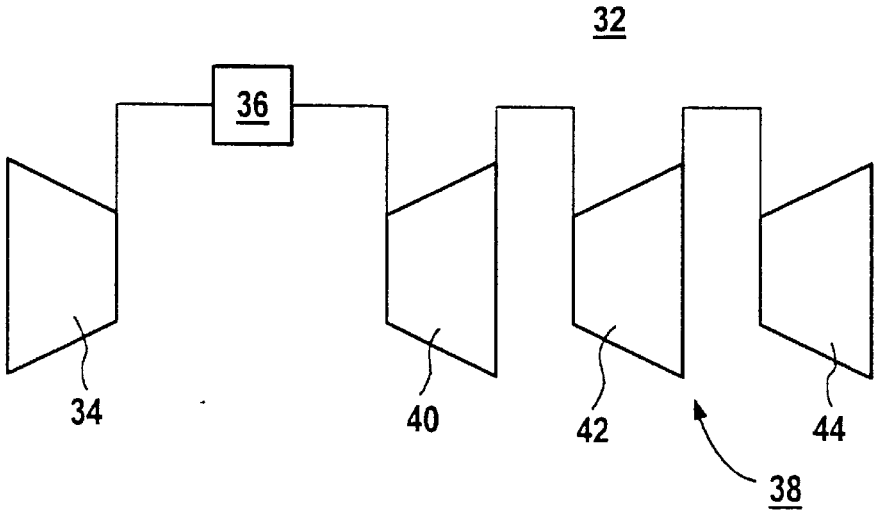
FIG. 6 shows a turbine plant diagrammatically.

FIG. 6 shows a turbine plant 32 with a compressor 34, a combustion chamber 36 and a multistage turbine 38. The hot working medium, for example a hot gas, generated in the combustion chamber 36 by combustion is in this case expanded in the respective stages of the turbine 38. As a function of the temperatures occurring in the turbine 38, the first turbine stage 40 has at least one row of turbine blades 1 which are formed essentially from carbon-fiber-reinforced material. As a function of the temperature and pressure conditions in the second and third turbine stages 42 and 44, these have both rows of conventional turbine blades, for example cast metallic turbine blades, and turbine blades 1 composed of carbon-fiber-reinforced carbon. In this case, turbine blades 1 with different protective layers 18 are used.

The advantages of the invention are, in particular, that a particularly high turbine inlet temperature is made possible by a turbine blade 1 which is formed from carbon-fiber-reinforced carbon and which is surrounded at least in the blade leaf region 6 by a protective layer 18. Furthermore, it is particularly advantageous that cooling is no longer necessary because of the high temperature resistance of the material of the turbine blade 1. Another advantage is that, on account of the low specific masses (mass density) of the turbine blade 1, when rotation occurs during operation the rotating mass is reduced by the factor 10, as compared with a conventionally cast turbine blade, with the result that the strength of the turbine blade 1 is markedly improved. Moreover, the use of carbon-fiber-reinforced carbon makes it possible to have a marked reduction in the thermal expansion of the turbine blade 1, with the result that gap losses are avoided, or at least reduced. Furthermore, when natural gas is used to compose the protective layer 18, the natural gas introduced into the working space of the gas turbine allows intermediate combustion or post-combustion which additionally brings about an increase in efficiency.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A turbine blade, which extends along a major axis from a root region via a blade leaf region acted upon by hot gas to a head region, formed essentially from carbon-fiber-reinforced carbon, comprising:

at least the blade leaf region including a blade outer wall with carbon-fiber-reinforced carbon, said blade outer wall being surrounded by a protective layer, formed at least by a gaseous protective film composed of a protective gas, and at least in the blade leaf region, a feed for the protective gas being provided, which is surrounded by a blade inner wall, wherein a plurality of cavities are formed between the blade outer wall and the blade inner wall, and wherein a plurality of spacers, which are arranged in a grid, are provided for forming the cavities.

2. The turbine blade as claimed in claim 1, in which the protective layer includes, in addition to the protective film, a ceramic layer.

3. The turbine blade as claimed in claim 2, in which the ceramic layer is silicon carbide.

4. The turbine blade as claimed in claim 2, in which the ceramic layer has a minimum layer thickness of between 0.5 and 5 mm.

5. The turbine blade as claimed in claim 1, in which natural gas, water vapor or inert gas is provided as the protective gas.

6. The turbine blade as claimed in claim 1, in which the spacers are composed of carbon-fiber-reinforced carbon.

7. The turbine blade as claimed in claim 6, in which, in the blade outer wall, a plurality of discharges are provided, which guide the protective gas outward from each cavity.

8. The turbine blade as claimed in claim 1, in which, in the blade outer wall, a plurality of discharges are provided, which guide the protective gas outward from each cavity.

9. The turbine blade as claimed in claim 1, in which the wall thickness of at least one of the blade outer wall and the blade inner wall has a minimum value of between 0.5 mm and 5 mm.

10. The turbine blade as claimed in claim 1, designed as at least one of a moving blade and a guide blade of a turbine.

11. The turbine blade of claim 10, wherein the blade is designed as at least one of a moving and guide blade of a gas turbine.

12. The turbine blade of claim 10, wherein the blade is designed as at least one of a moving and guide blade of a steam turbine.

13. A turbine plant comprising:

a compressor, a combustion chamber; and a multistage turbine, in the respective stages of which a working medium generated in the combustion chamber is expandable, at least one stage comprising at least one row of turbine blades as claimed in claim 1.

14. The turbine plant as claimed in claim 13, wherein in the blade outer wall of a turbine blade, a plurality of discharges are provided, which guide the protective gas outward from each cavity.

15. A turbine blade, which extends along a major axis from a root region via a blade leaf region acted upon by hot gas to a head region, formed essentially from carbon-fiber-reinforced carbon, comprising:

at least the blade leaf region including a blade outer wall with carbon-fiber-reinforced carbon, said blade outer wall being surrounded by a protective layer, formed at least by a gaseous protective film composed of a protective gas, and at least in the blade leaf region, a feed for the protective gas being provided, which is surrounded by a blade inner wall, wherein a plurality of cavities are formed between the blade outer wall and the blade inner wall, wherein the plurality of cavities are flow connected to the feed by at least one associated inlet and wherein a plurality of spacers, which are arranged in a grid, are provided for forming the cavities.

16. The turbine blade as claimed in claim 15, in which the spacers are composed of carbon-fiber-reinforced carbon.

17. The turbine blade as claimed in claim 15, in which, in the blade outer wall, a plurality of discharges are provided, which guide the protective gas outward from each cavity.

* * * * *